United States Patent [19]

Akhter

[11] Patent Number: 4,575,597

[45] Date of Patent: Mar. 11, 1986

[54] FLOAT SWITCH ASSEMBLY HAVING MERCURY-TYPE SWITCH MOVABLY RETAINED WITHIN A CAGE

[75] Inventor: Pervez Akhter, Ft. Wayne, Ind.

[73] Assignee: The Scott & Fetzer Company, Fort Wayne, Ind.

[21] Appl. No.: 637,397

[22] Filed: Aug. 3, 1984

[51] Int. Cl.[4] ..... H01H 35/18

[52] U.S. Cl. ..... 200/84 R; 200/61.52; 200/190; 200/230; 73/322.5

[58] Field of Search ..... 340/623, 625; 307/118; 73/308, 313, 314, 318, 322.5; 200/190, 220, 230, 153 A, 61.52, 81.9 HG, 84 R, 84 B

[56] References Cited

U.S. PATENT DOCUMENTS 3,543,580 12/1970 McGill ..... 200/84 B

*Primary Examiner*—G. P. Tolin

*Attorney, Agent, or Firm*—Jeffers, Irish & Hoffman

[57] ABSTRACT

A position responsive switch apparatus comprising a housing and a mounting assembly secured within the housing. The mounting assembly includes a pair of oppositely disposed spaced-apart walls. Each of the walls has an aperture contained therein which are in general axial alignment. An elongate switch extends through the apertures and is transversely supported by the mounting assembly so that the switch may move in a generally longitudinally axial direction within the confines of the mounting assembly. The switch may be in one of two preselectd conditions. The switch moves from one condition to the other condition in response to an opposing directional displacement of the switch. A retaining element is carried on the switch intermediate of the apertures. The retaining element is of a greater dimension than the apertures so that the walls moveably retain the switch within the mounting assembly.

10 Claims, 9 Drawing Figures

FLOAT SWITCH ASSEMBLY HAVING MERCURY-TYPE SWITCH MOVABLY RETAINED WITHIN A CAGE

BACKGROUND OF THE INVENTION

The invention relates to float switches, and in particular, to float switches used in conjunction with sump pumps or the like for maintaining the fluid level in a sump or other container between a low level and a high level.

Heretofore, there have been provided float switch assemblies which operate to maintain the fluid level in a container between a high and a low level. U.S. Pat. No. 4,302,641 illustrates such a float switch.

Earlier float switches do not appear to have been constructed to facilitate efficient manufacture and assembly thereof. It would be desirable to provide an improved float switch that uses components that are relatively easy to manufacture and assemble.

It would also be desirable to provide an improved float switch that is reliable in its operation whereby the wires that extend from the mercury-type switch do not hinder the movement of the mercury-type switch.

It would also be desirable to provide an improved float switch that is reliable in its operation in that it uses a mercury-to-mercury type of switch.

SUMMARY OF THE INVENTION

It is an object of the invention to provide an improved position responsive float switch apparatus.

In one form thereof, the invention is a position responsive switch apparatus which comprises a housing and a mounting assembly secured within the housing. The mounting assembly includes a pair of oppositely disposed spaced-apart walls. Each of the spaced-apart walls has an aperture contained therein, and the apertures are in general axial alignment.

An elongate switch extends through the apertures and is transversely supported by the mounting assembly so that the switch may move in a generally longitudinally axial direction within the confines of the mounting assembly. The switch may be in one of two preselected conditions. The switch moves from one condition to the other condition in response to an opposing directional displacement of the switch. A retaining element is carried on the switch intermediate the apertures. The retaining element is of a greater dimension than the apertures so that the walls moveably retain the switch within the mounting assembly.

In another form thereof, the invention is a float switch responsive to fluid level in a container. The float switch comprises a fluid-tight housing having opposite ends. One of the ends is moveable in response to fluid level to a greater degree than the other end so that the housing tilts toward one of the ends when the fluid level reaches a predetermined high level, and the housing tilts toward the other of the ends when the fluid level reaches a predetermined low level.

The float switch further comprises a mounting assembly that is secured within the housing. The mounting assembly includes a pair of spaced-apart connected walls forming a cage so as to define a volume within the cage. A mercury-type switch having an elongate body with opposite ends includes a single enlarged retainer positioned thereon mediate of the switch ends. The switch passes through the volume and the retainer is continuously within the volume so that the switch is tiltably mounted within the mounting assembly. The switch is tiltable between two conditions so that the switch moves to one condition when the fluid level reaches a predetermined high level, and the switch moves to the other condition upon the fluid level reaching a predetermined low level.

In another form thereof, the invention is a float switch for use in a fluid retaining sump with a sump pump wherein the switch comprises a fluid-tight housing adapted to float in the fluid in the sump. The housing includes a canister having an open end and a cover received on the canister.

The float switch further includes a mounting assembly contained with the housing. The mounting assembly includes a pair of spaced-apart integral retaining walls forming a cage wherein the cage defines a retaining volume. A switch means, which is contained by the mounting assembly, controls the activation of the sump pump.

The cover includes electrical means for electrically connecting the switch means to the sump pump. The switch means includes a retainer mounted thereto so as to be continuously retained within the retaining volume so that the switch is tiltable between one and the other of two conditions upon sufficient axial movement of the switch. When the switch means is in one of two conditions, the sump pump is activated, and when the switch means is in the other condition, the sump pump is not activated.

BRIEF DESCRIPTION OF THE DRAWINGS

The above mentioned and other features and objects of the present invention, and the manner of attaining them, will become more apparent and the invention itself will be best understood by reference to the following description of an embodiment of the invention taken in conjunction with the accompanying drawings.

DETAILED DESCRIPTION OF A SPECIFIC EMBODIMENT

Figure 2:
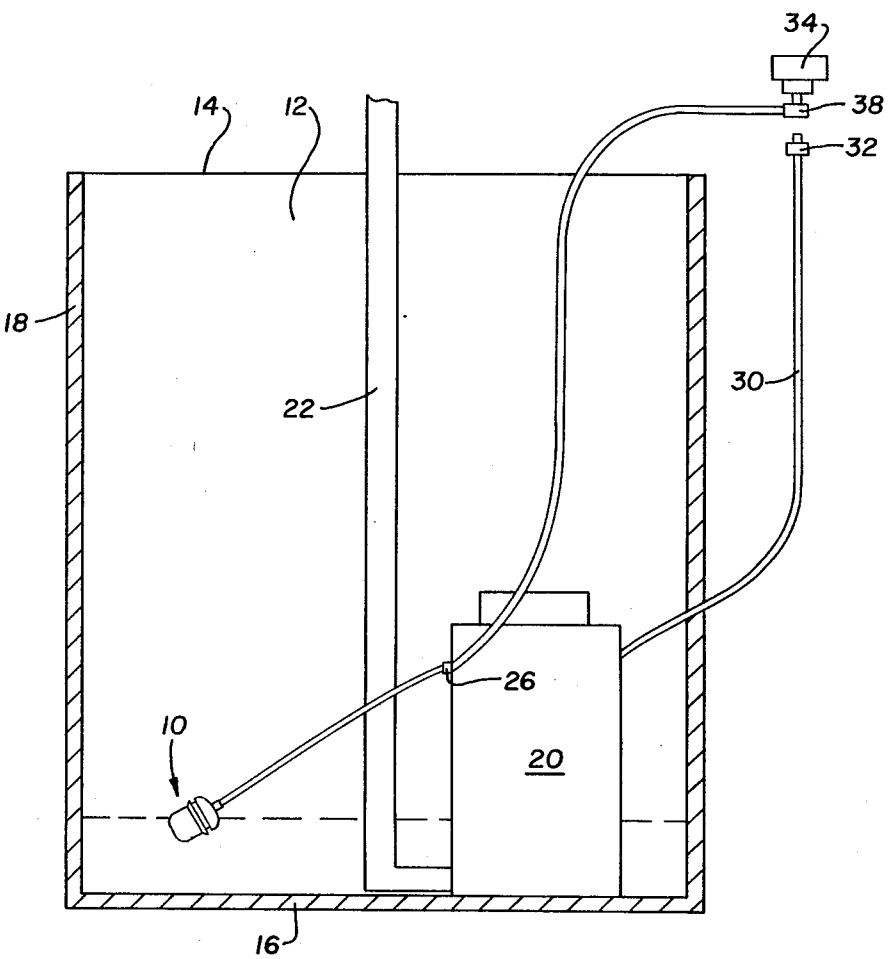
FIG. 2 is a diagrammatic view of the sump and sump pump and float switch of FIG. 1 wherein the fluid level is illustrated as being at a predetermined low level.
Figure 1:
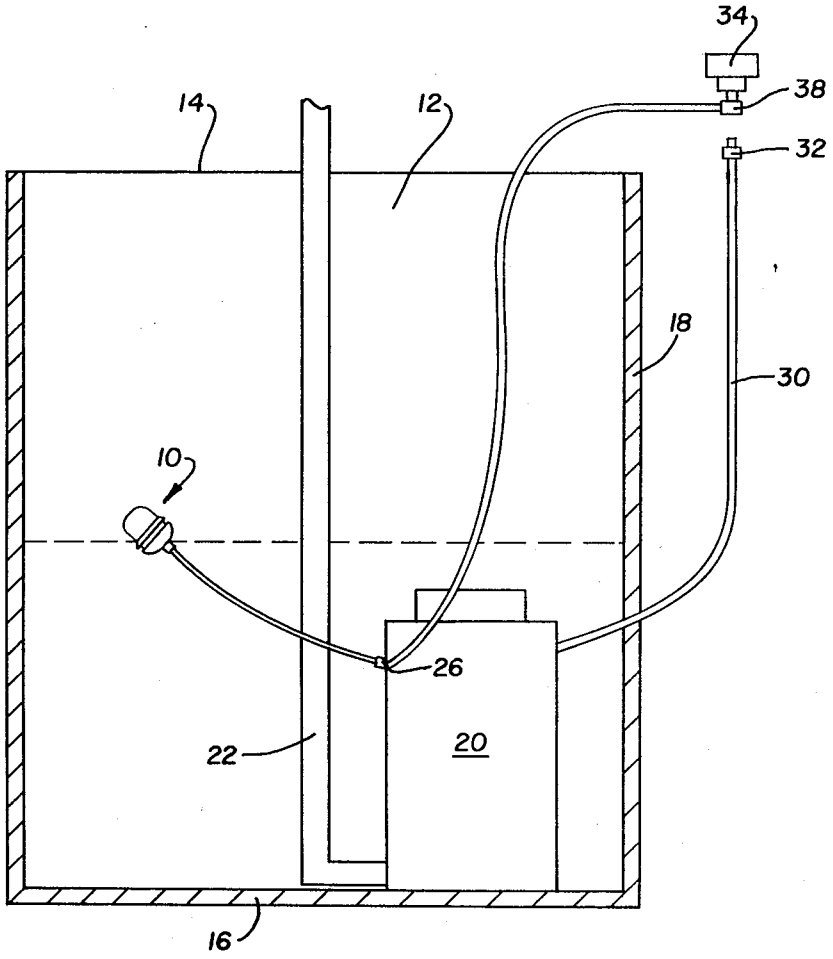
FIG. 1 is a diagrammatic view of a sump and sump pump with a float switch contained within the sump wherein the fluid level is at a predetermined high level.

Referring to FIGS. 1 and 2, there is illustrated a specific embodiment of the float switch generally designated as 10. Float switch 10 is illustrated as floating in a container or sump 12. Container 12 has an open top 14, a bottom wall 16, and a side wall 18.

A sump pump 20 is contained within container 12. Sump pump 20 includes an inlet (not illustrated) and an outlet pipe 22. Fluid is pumped into the pump via the inlet and out of the pump by pipe 22. An electrical cord 30 extends from sump pump 20. Cord 30 includes a plug 32 at one end thereof. Sump pump 20 is of a conventional construction so that further description thereof is not necessary.

An electrical cord 36 extends from float switch 10 and is secured along its length to sump 20 by clip 26. This causes switch 10 to move in an arcuate path about clip 26 as the fluid level changes. Cord 36 includes a "piggy-back" type plug 38 at the free end thereof. Plug 38 is directly connected to electrical outlet 34. Plug 32 is plugged into plug 38.

Clip 26 is a clamp-type clip which can be loosened to allow the cord 36 to slide therethrough and then be tightened so that the cord will not slip in an axial direction. As can be appreciated, such a clip will permit the portion of cord 36 that can be considered as a tether for the float to vary in length. By varying the length of the tether portion the range between the high and low fluid levels can be changed. For example, a relatively narrow range will result if the tether portion is relatively short and a relatively wider range will result if the tether is relatively long.

The detailed operation of the float switch 10 will be set out hereinafter. Applicant will now, however, set out a brief description of the operation of the float switch. FIG. 1 illustrates the fluid level in container 12 being at its high level $L_1$. When the fluid reaches this level, the mercury-type switch contained with float switch 10 is tilted to such an extent that electrical power is permitted to flow to sump pump 20 so as to energize the pump. When sump pump 20 goes into operation, fluid is pumped from container 12 through the pump inlet and out of the pipe 22. The result is that the fluid level in the container decreases until it reaches its predetermined low level $L_2$. See FIG. 2.

As is illustrated in FIG. 2, the fluid level in container 12 has reached a predetermined low level $L_2$. At this point, the mercury-type switch is tilted in the opposite direction to the way it was tilted in FIG. 1. At this point, electrical power is no longer permitted to flow to sump pump 20 so that it no longer operates. Fluid is thus not pumped from container 12. Fluid can now build up in container 12. As can be appreciated, the operation of sump pump 20 commences when the fluid level reaches the predetermined high level $L_1$ and ceases when the fluid level reaches the predetermined low level $L_2$. The end result of which is that the fluid level within container 12 is maintained between high level $L_1$ and low level $L_2$.

Figure 3:
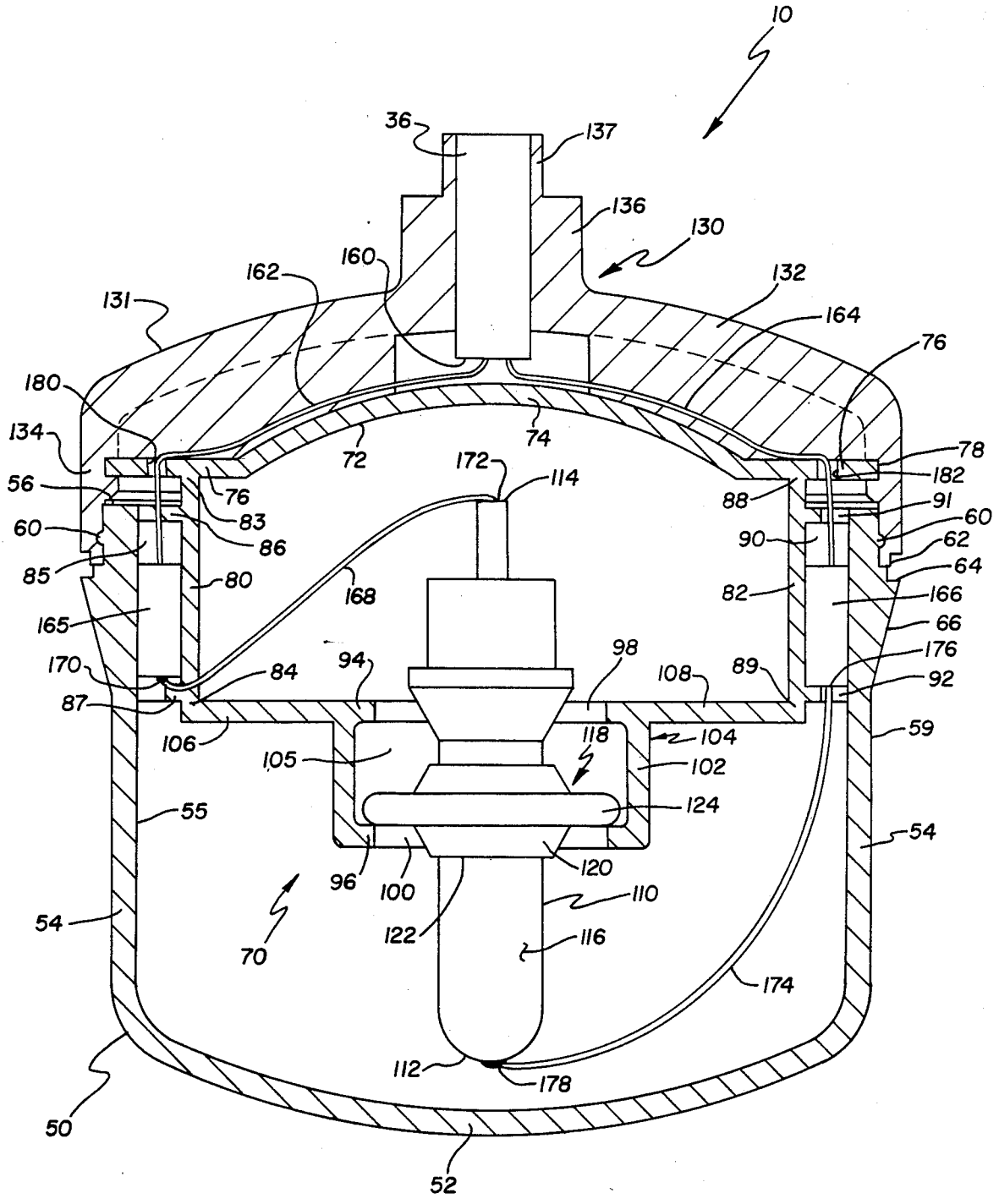
FIG. 3 is a central cross-sectional view of a specific embodiment of the float switch of the invention.

Referring to FIG. 3, float switch 10 includes a one-piece canister 50. Canister 50 can be made out of a hard plastic material so as to provide a durable yet light weight housing for the switch. Canister 50 includes a dome-shaped closed end 52 and an integral cylindrical wall 54. Cylindrical wall 54 includes a smooth interior wall surface 55 as well as a peripheral edge 56. Peripheral edge 56 defines the open end of canister 50.

Canister 50 further includes a contoured exterior wall 59. An annular projection 60 projects from exterior wall 59 adjacent peripheral edge 56. Exterior wall 59 further includes a pair of spaced-apart annular shoulders 62 and 64. A sloped annular surface 66 connects annular shoulder 64 with the remainder of the exterior wall 59 of canister 50.

As can be appreciated, float switch 10 needs to be bouyant. Canister 50 needs to be dimensioned so that the volume within canister 50 is sufficiently large to give the complete float switch adequate bouyancy. Optimum bouyancy exists when between 75% to 90% of the volume of the float switch is above the surface of the liquid.

Float switch 10 further includes a mounting assembly generally designated as 70. Mounting assembly 70 includes a circular top cap 72. Circular top cap 72 includes an integral domed portion 74 surrounded by an integral peripheral flat portion 76. Flat portion 76 terminates in a peripheral circular edge 78.

Mounting assembly 70 further includes a pair of oppositely disposed longitudinal support members 80 and 82. Support member 80 includes a top end 83 adjacent circular top cap 72 and a bottom end 84. Support member 80 further includes a pair of longitudinally spaced-apart radially extending forks 85. A top wire guide 86 having an aperture **86*a* is positioned between forks 85 near top end 83. A bottom wire guide 87 having an aperture 87*a* is positioned near bottom end 84. Longitudinal support member 82 includes a top end 88 adjacent circular top cap 72 and a bottom end 89. Longitudinal support member 82 further includes a pair of longitudinally spaced-apart radially extending ports forks 90. A top wire guide 91 having an aperture 91*a* is positioned between forks 90 near top end 88. A bottom wire guide 92 having an aperture 92*a* is positioned near bottom end 89. Forks 85 extend in a direction opposite to the direction in which forks 90** extend.

Mounting assembly 70 further includes a pair of transversely disposed retainer walls 94 and 96. Walls 94 and 96 each contain therein an aperture 98 and 100, respectively. Apertures 98 and 100 are in general axial alignment. Walls 94 and 96 are joined by an integral cylindrical side wall 102. Walls 94 and 96 and side wall 102 together define a cage generally designated as 104. A retainer volume 105 is contained within and defined by cage 104. A pair of oppositely disposed integral arms 106 and 108 radially extend from wall 94. Arms 106 and 108 are connected to the bottom ends of longitudinal supports 80 and 82, respectively.

Switch 110 is an elongate mercury-to-mercury contact type of switch having opposite ends 112 and 114. Switch 110 further includes a smooth cylindrical external surface 116. An annular retainer 118 includes a body portion 120 containing an aperture 122 therein. A radially extending flange 124 extends from body portion 120. Annular retainer 118 is secured at aperture 122 to surface 116 of switch 110 mediate between ends 112 and 114. Switch 110 is positioned so that annular retainer 118 is continually contained within container volume 105 defined by cage 104. As can be appreciated by viewing FIG. 3, the external diameter of annular retainer 118 is larger than the diameter of aperture 98 or aperture 100. As will become apparent hereinafter, annular retainer 118 is continuously retained within retaining volume 105 regardless of the orientation of the switch 110.

Figure 8:
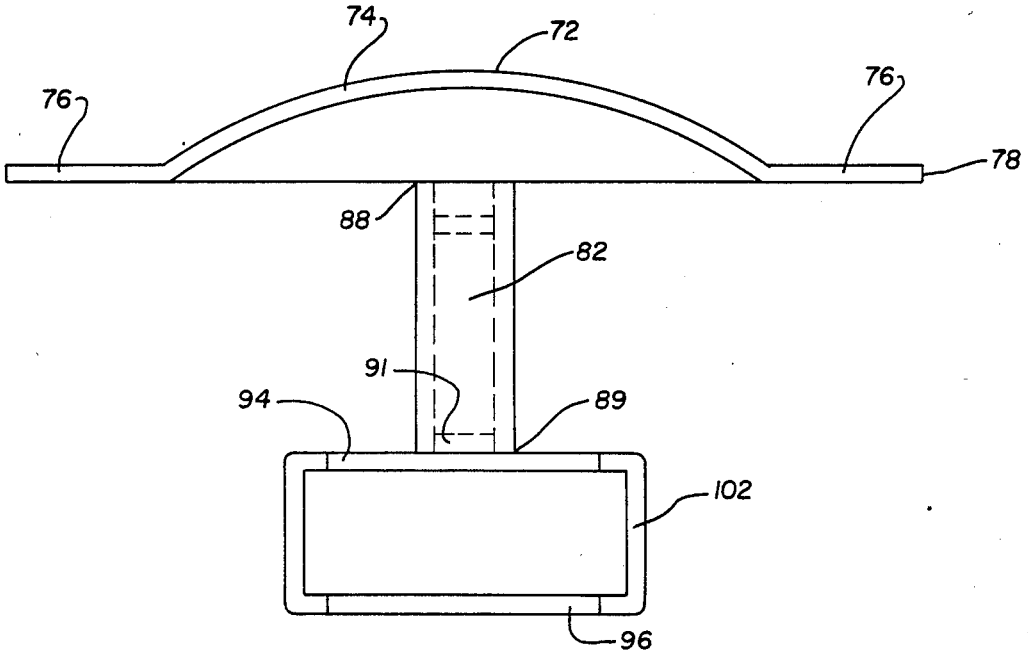
FIG. 8 is a side view of one-half of the mounting assembly of the float switch of FIG. 3.
Figure 9:
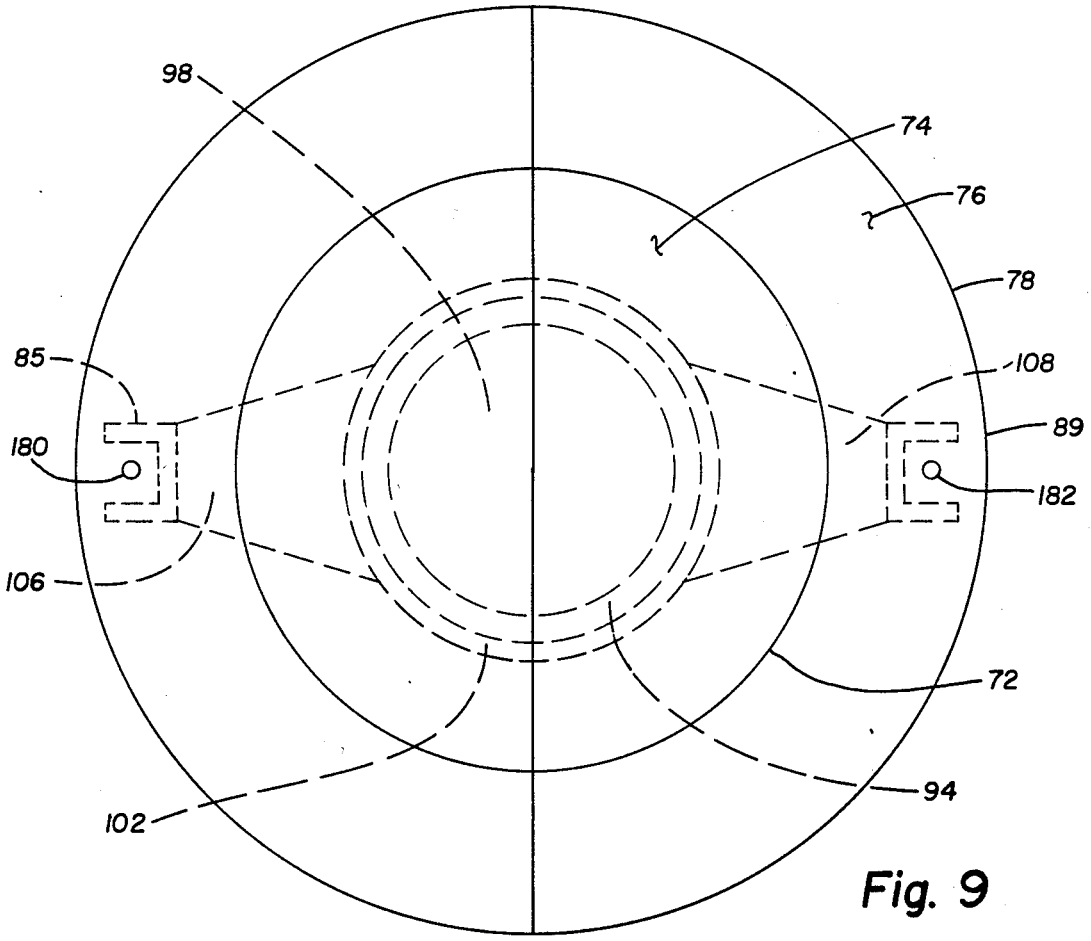
FIG. 9 is a top plan view of the mounting assembly of the float switch of FIG. 3.

As can be appreciated from viewing FIGS. 3, 8 and 9, mounting assembly 70 is an integral component comprised of two symmetric halves. The halves are secured together by any appropriate means to comprise the complete mounting assembly. For ease of assembly, switch 110 is positioned relative to cage 104 so that retainer 118 is within volume 105 prior to the two halves being joined to form the complete mounting assembly.

Figure 5:
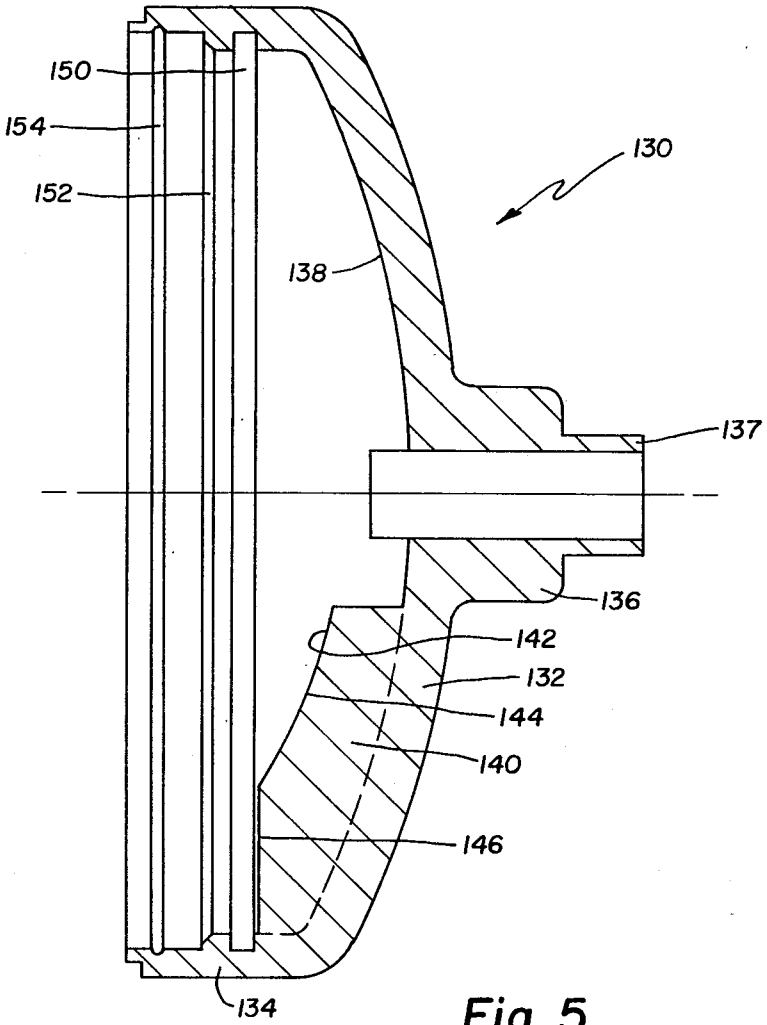
FIG. 5 is a cross-sectional view of the cover taken along section line 5—5 of FIG. 4.
Figure 4:
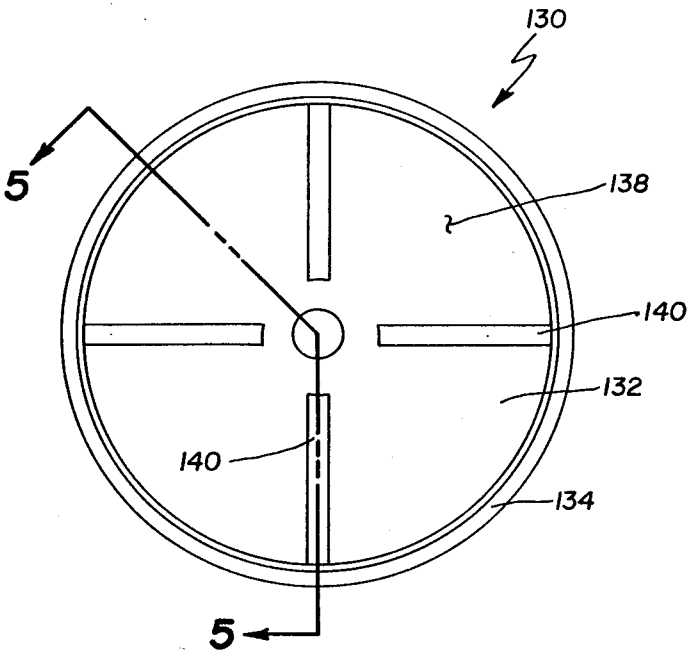
FIG. 4 is a bottom plan view of the cover of the float switch of FIG. 3.

Referring specifically to FIGS. 3, 4, and 5, float switch 10 further includes an injection molded soft PVC cover generally designated as 130. Cover 130 includes a body portion 131 that is integrally joined to cord 36. Body portion 131 includes an arcuate portion 132 and an integral annular depending flange 134. An integral upstanding neck 136 extends from the geometric center of arcuate portion 132 and surrounds cord 36. A thin neck seal 137 extends from the free edge of upstanding neck 136 and also surrounds cord 36 so as to form a fluid-tight seal. Cover 130 further includes an interior surface 138 having a plurality of integral ribs 140 depending therefrom. Each rib 140 includes a terminating edge 142 having an arcuate portion 144 and a flat portion 146. The interior surface 138 in the area of depending flange 134 includes an annular square channel 150, an annular beveled shoulder 152, and an annular semi-circular channel 154. See FIG. 5.

Cord 36 is placed in the mold for the cover body portion 131 prior to the injection of liquid PVC. When the liquid PVC contacts the cord there is a certain bonding that occurs therebetween. Cord 36 can thus be considered as an integral part of cover 130. There is, of course, a fluid-tight connection formed between cord 36 and cover 130. Electrical cord 36 includes one end to which plug 38 is connected and another end 160 which opens up into the interior of the float switch. Cord 36 includes one electrical connector 162 contained therein which travels the length of cord 36 as well as having a portion of connector 162 extending out of open end 160. Cord 36 further includes another electrical connector 164 contained therein. Connector 164 also travels the length of cord 36 and includes a portion that passes out of open end 160 of cord 36.

Referring again to FIG. 3, it should be understood that the applicant's float switch is designed for ease of manufacture and ease of assembly. This will be appreciated from the following description of the assembly of the float switch. The mercury-type switch 110 is positioned within the cage 104 of the mounting assembly 70. The two halves of mounting assembly 70 are then attached together. The retainer of switch 110 is thus retained within cage 105. Flexible leads 168 and 174 are already welded at the appropriate one ends thereof to their respective end of the mercury-type switch 110.

The next step in the assembly of the float switch is to attach the mounting assembly to the soft PVC cover. However, prior to doing so, the free end of connector 162 is fed through apertures 180 and 86*a*, and the free end of connector 164 is fed through apertures 182 and 91*a*. Once the electrical connectors 162 and 164 are positioned, glue or some other adhesive is applied to channel 150 and also to the bottom edges of ribs 140. Mounting assembly 70 and cover 130 are then moved together in an axial direction without resistance until the beveled shoulder 152 of cover 130 contacts the flat peripheral portion 76 of cap 72. At this point, continued application of an axially directed force on the cover toward the mounting assembly causes the beveled portion to ride against the peripheral edge 78. This results in the flange 134 of cover 130 being expanded radially outwardly. Once flange 134 has expanded so that beveled portion 152 clears peripheral edge 78, continued application of force in the axial direction toward mounting assembly 70 results in peripheral edge 78 being received within channel 150 of cover 130. The glue within channel 150 facilitates the very secure attachment of the cover to the mounting assembly. Further, the bottom edge of the ribs contact the top surface of cap 72 so that the glue on the ribs also facilitates the secure attachment of the cover to the mounting assembly.

In viewing FIG. 3, it is now seen that the portion of connector 162 which extends out of end 160 travels along the exterior surface of the domed portion 74 of top cap 72, and passes through an aperture 180 found in the flat portion 76 of cap 72 as well as aperture 86*a* found in wire guide 86. The free end of electrical connector 162 is received by butt splice 165. But splice 165 is now crimped adjacent the end that receives connector 162. The free end of flexible wire 168 is now fed through aperture 87*a* and into the uncrimped end of butt splice 165 and that end of butt splice 165 is crimped. Connector 162 and flexible wire 168 are now electrically connected by butt splice 165. Wire 168 is now bent in a question mark shape or configuration so as to provide for the free movement of the switch.

The portion of electrical connector 164 that extends out of end 160 travels along the exterior surface of domed portion 74 and passes through aperture 182 found in flat portion 76 of cap 72 as well as aperture 91*a* found in wire guide 91. Free end of electrical connector 164 is received by butt splice 166. Butt splice 166 is now crimped adjacent the end that receives connector 164.

The free end of flexible wire 174 is now fed through aperture 92*a* and into the uncrimped end of butt splice 166 and that end of butt splice 166 is crimped. Connector 164 and flexible wire 174 are now electrically connected by butt splice 166. Wire 174 is now bent in a question mark shape or configuration so as to provide for the free movement of switch 110. By bending wires 168 and 174 in a question mark shape, they do not impede the movement of switch 110 during the operation of the float switch when it moves depending upon the fluid level in the container.

Referring to FIGS. 3 and 5, once the above-described electrical connections have been made, the canister is ready to be snap fit onto the mounting assembly and cover. Glue or some other adhesive is first applied to channel 154. The canister and the assembly of the mounting assembly and top cover are now moved toward each other in an axial direction. The projection 60 is received in channel 154. The glue in channel 154 facilitates the canister being securely attached to the top cover. Further, the bottom edge of flange 134 of cover 130 rests on shoulder 62 of the canister. It can thus be appreciated that the cover is assembled to the mounting assembly-canister assembly with relative ease. The end result is that there is now provided a fluid-tight float switch. The operation of the float switch will now be described in more detail.

It should be appreciated that switch 110 is a mercury-type switch. The nature of switch 110 is such that an electrical connection is made between wires 168 and 174 when the switch is positioned so that it tilts past a certain angle in a first direction. This condition is illustrated in FIG. 1 and in more detail in FIG. 7. The operation of switch 110 is not influenced by the rotation of switch 110 about its axis. When switch 110 is tilted past another specific angle in the opposite direction, electrical connection between wires 174 and 168 is broken. This condition is illustrated in FIG. 2 and in more detail in FIG. 6. As can be appreciated, the angle of tilt required to make or break electrical connection between the wires is determined by the dimensioning of the cage 105 in conjunction with the dimensioning of the mercury-type switch 110. In the specific embodiment illustrated, the included angle of tilt required to make or break the electrical connection is about 58°. The included angle of tilt is defined as the angle between the central axis B—B of switch 110 at the position illustrated in FIG. 7 and the central axis B—B of switch 110 at the position illustrated in FIG. 6. In other words, the included angle of tilt is the total angle that the switch 110 travels between the positions illustrated in FIGS. 6 and 7.

Figure 7:
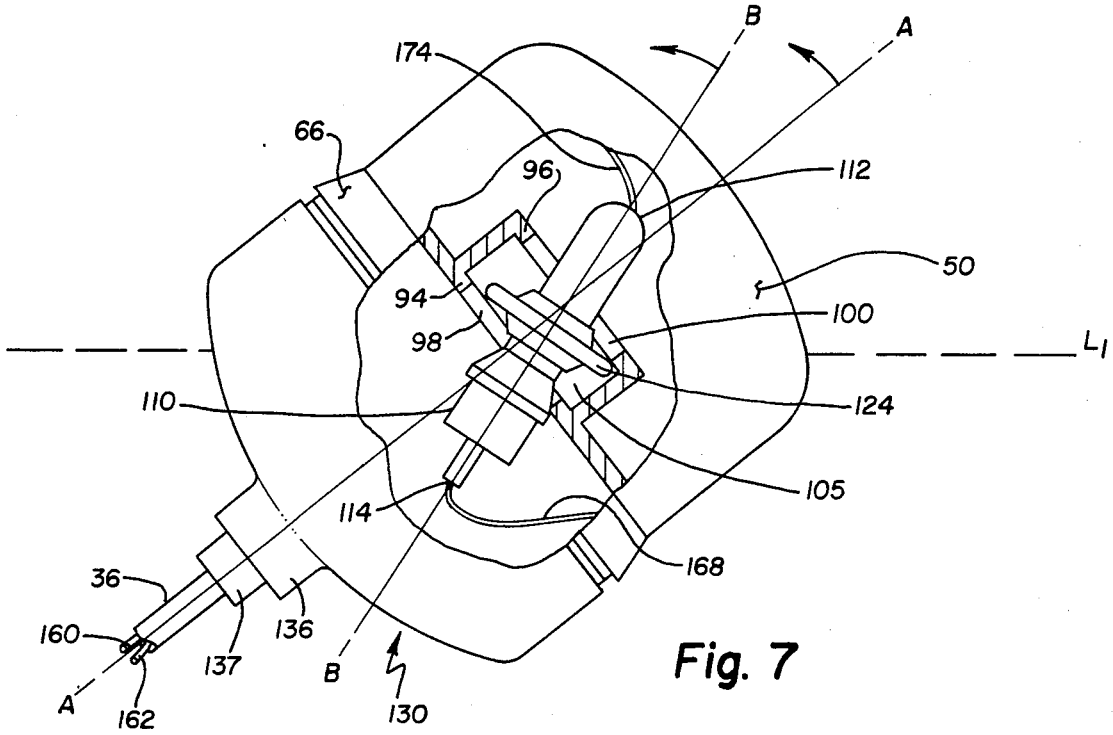
FIG. 7 is a view similar to FIG. 6 wherein the float switch is illustrated in a condition in which the fluid level is at the predetermined high level.

As the fluid level in container 12 rises, the assembly of the canister, mounting assembly and top cover begins to tilt in the direction illustrated in FIG. 7 (counterclockwise as viewed in FIG. 7). Once the fluid level reaches level $L_1$, gravity now acts on mercury-type switch 110 so as to suddenly tilt it to the position illustrated in FIG. 7. When switch 110 is in the position of FIG. 7, electrical connection is made between wires 168 and 174. The result of which is that sump pump 20 is energized and begins to pump out fluid from container 12.

Figure 6:
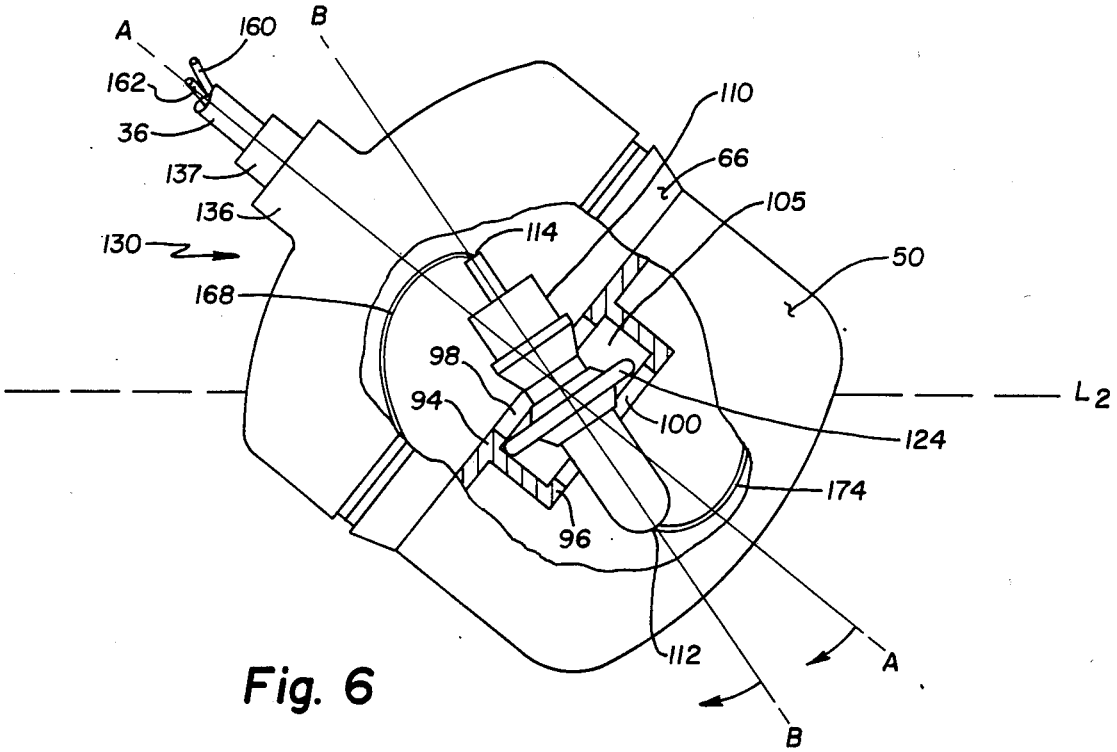
FIG. 6 is a side view of the float switch with a portion of the canister removed and a portion of the mounting assembly shown in cross-section, and the float switch is illustrated in a condition in which the fluid level is at a predetermined low level.

As fluid is pumped out of container 12, the previously-mentioned assembly of the canister, mounting assembly and top cover tilts in the direction illustrated in FIG. 6 (clockwise as viewed in FIG. 6). Once the fluid level reaches the low level $L_2$, gravity now acts on the mercury-type switch 110 so as to suddenly tilt it in the opposite direction to the position illustrated in FIG. 6. When switch 110 is in the position of FIG. 6, the electrical connection between wires 168 and 174 is broken thus deenergizing sump pump 20. Fluid is, of course, no longer pumped from container 12.

It can now be appreciated that the float switch will control the operation of sump pump 20 so as to cycle it between a predetermined high fluid level $L_1$ and a predetermined low fluid level $L_2$. Upon the fluid reaching the predetermined high fluid level, the sump pump 20 will be energized and will reduce the fluid level in the container 12 until it reaches predetermined low fluid level $L_2$. At this point, sump pump 20 will shut off. Sump pump 20 will not be turned on again until the fluid level reaches the predetermined high fluid level $L_1$.

While there have been described above the principles of this invention in connection with specific apparatus, it is to be clearly understood that this description is made only by way of example and not as a limitation to the scope of the invention.

What is claimed is:

1. A float switch for use in a fluid-retaining sump with a sump pump comprising:

a canister having an open end defined by a peripheral edge, said canister having a shaped exterior surface defining a shoulder and a projection near said peripheral edge;

a mounting assembly including a cap having a peripheral edge, a pair of oppositely disposed support members depending from said cap, a retaining cage connected to said support members and defining a retaining volume, a switch means, movably contained by said mounting assembly, for controlling the activation of the sump pump, said switch means including a switch having a retainer mounted thereto, said retainer being continuously retained within the retaining volume so that said switch may tilt between one and the other of two conditions;

a cover having a depending flange, said flange having an interior surface in which is contained a pair of axially-spaced channels, said cover including electrical means for electrically connecting said switch means to the sump pump;

said peripheral edge of said cap being received within one of said channels so as to form a first assembly for connection to said canister, said first assembly comprising the mounting assembly, the switch means and the cover; and said canister projection being received within the other of said channels so as to join together said canister and said first assembly to form the float switch.

2. The float switch of claim 1 wherein said electrical means includes an integral flexible electrical conduit extending from said cover, and electrical connectors contained within said conduit and extending out of said conduit, said electrical connectors connected to said switch means.

3. The float switch of claim 2 wherein a pair of said connectors are contained within said conduit, one of said connectors is attached to one end of said switch and other of said connectors is attached to the other end of said switch, said connectors being configured so as to permit free movement of said switch.

4. The float switch of claim 3 wherein the portions of said connectors adjacent said switch are each configured in the shape of a question mark.

5. The float switch of claim 1 wherein said cover flange terminates in a cover edge, and said cover edge abuts against said shoulder of said canister.

6. The float switch of claim 2 wherein said cap includes inner and outer surfaces, said cover having inner and outer surfaces, a plurality of integral ribs projecting from said inner cover surface and abutting against said top surface of said cap so as to form channels defined by said adjacent ribs and said cover and said cap, and said electrical connectors passing through selected ones of said channels.

7. The float switch of claim 1 wherein said mounting assembly includes a pair of spaced apart retainer portions joined by a wall to define the retaining cage, each of said retainer portions having an aperture therein, said retainer carried on said switch intermediate said apertures, said retainer being of greater dimension than said apertures.

8. A float switch for use in a fluid-retaining sump with sump pump comprising:

an elongate cylindrical canister having a closed end and an open end defined by a peripheral edge, said canister having an exterior surface from which an annular projection and an annular shoulder radially extend, said annular projection and shoulder being axially spaced apart and positioned near said peripheral edge;

a mounting assembly including a circular cap having a circumferential edge, a pair of oppositely disposed integral support members axially depending from said cap, and integral retaining cage connected to said support members by a pair of radially extending integral arm portions;

an elongate mercury-type switch having opposite ends, an annular retainer carried on said switch, said switch retainer being continuously retained within the retaining cage whereby said switch may move between two basic conditions wherein when the switch is in one condition the sump pump is activated and when the switch is in the other condition the sump pump is not activated;

a circular cover having an axially depending flange that terminates in an annular peripheral edge, said cover having an interior surface in which a pair of axially spaced channels are contained, said channels being in the area of the flange, said cover further includes an integral flexible conduit extending outwardly of said cover, and a pair of electrical connectors are contained within said conduit and extend inwardly of the cover; and said mounting assembly being recieved by said cover wherein the circumferential edge of the cap is contained within one of said channels, said canister being received by said cover wherein the annular projection is contained within the other of said channels, said other channel being spaced axially inward of said one channel, and the peripheral edge of the cover abutting against said shoulder.

9. The float switch of claim 8 wherein said depending support members are spaced, radially inwardly from the interior surface of the canister, an electrical butt splice is positioned within each volume defined between said support and the interior surface of the canister and receives its respective electrical connector, an additional electrical connector extends from each butt splice and is connected to its selected opposite end.

10. A float switch for use in a fluid-retaining sump with a sump pump, the switch comprising:

a fluid-tight housing adapted to float in the fluid in the sump, said housing including a canister having an open end and a cover received on said canister;

a mounting assembly contained within said housing, said mounting assembly including a cap received by said cover, a pair of oppositely disposed support members depending from the cap, a retaining cage connected to said support members and defining a retaining volume, a pair of spaced apart retaining portions joined by a wall to define the retaining cage, each of said retaining portions having an aperture therein;

a switch means, movably contained by said mounting assembly, for controlling the activation of the sump pump;

said cover including electrical means for electrically connecting said switch means to the sump pump;

said switch means including a switch having a retainer mounted thereto, said retainer being of greater dimension than said apertures, said retainer being continuously retained within the retaining volume so that said switch may tilt between one and the other of two conditions, when said switch is in one of said conditions the sump pump is activated and when in the other of said conditions the sump pump is not activated.

* * * * *

UNITED STATES PATENT AND TRADEMARK OFFICE

CERTIFICATE OF CORRECTION

PATENT NO. : 4,575,597

DATED : March 11, 1986

INVENTOR(S) : Pervez Akhter

It is certified that error appears in the above-identified patent and that said Letters Patent is hereby corrected as shown below:

Claim 8, Col. 8, line 50, insert --a-- after "with".

Claim 8, Col. 9, line 14, change "recieved" to --received--.

In the Abstract, line 11, change "preselectd" to --preselected--.

Signed and Sealed this

Tenth Day of June 1986

[SEAL]

*Attest:*

DONALD J. QUIGG

*Attesting Officer*

*Commissioner of Patents and Trademarks*